United States Patent [19]

Yan

[11] Patent Number: 4,544,479

[45] Date of Patent: Oct. 1, 1985

[54] RECOVERY OF METAL VALUES FROM PETROLEUM RESIDUA AND OTHER FRACTIONS

[75] Inventor: Tsoung-Yuan Yan, Philadelphia, Pa.

[73] Assignee: Mobil Oil Corporation, New York, N.Y.

[21] Appl. No.: 556,808

[22] Filed: Dec. 1, 1983

Related U.S. Application Data

[63] Continuation-in-part of Ser. No. 340,661, Jan. 19, 1982, abandoned, which is a continuation-in-part of Ser. No. 224,778, Jan. 13, 1981, Pat. No. 4,334,976, which is a continuation-in-part of Ser. No. 186,927, Sep. 12, 1980, Pat. No. 4,317,711.

[51] Int. Cl.[4] ..... C10G 9/00; C10G 25/06; C10G 25/12

[52] U.S. Cl. ..... 208/106; 208/126; 208/251 R; 423/64; 423/68; 423/150

[58] Field of Search ..... 208/96, 106, 251 H, 208/251 R, 107, 177, 309, 150, 151, 126; 423/64, 68

[56] References Cited

U.S. PATENT DOCUMENTS

| | | | |
|---|---|---|---|
| 4,094,770 | 6/1978 | Bose | 208/251 R |
| 4,162,958 | 7/1979 | Baldwin | 208/8 LE |
| 4,227,995 | 10/1980 | Sze et al. | 208/251 H |
| 4,243,639 | 1/1981 | Haas et al. | 423/63 |
| 4,277,324 | 7/1981 | Greenwood | 208/45 |
| 4,299,685 | 11/1981 | Khulbe et al. | 208/48 AA |
| 4,390,409 | 6/1983 | Audeh | 208/8 LE |
| 4,439,313 | 3/1984 | Schindler et al. | 208/307 |
| 4,481,101 | 11/1984 | Yan | 208/50 |

FOREIGN PATENT DOCUMENTS

| | | | |
|---|---|---|---|
| 2093058 | 8/1982 | United Kingdom | 208/251 H |

*Primary Examiner*—D. E. Gantz
*Assistant Examiner*—O. Chaudhuri
*Attorney, Agent, or Firm*—Alexander J. McKillop; Michael G. Gilman; Malcolm D. Keen

[57] ABSTRACT

Visbreaking of heavy metals containing oil with 5 to 30, preferably 15 to 25 wt % pulverized coal gives good demetallation of oil and produces a solids product with a high metals content suitable for use as a synthetic, metal bearing ore.

18 Claims, 1 Drawing Figure

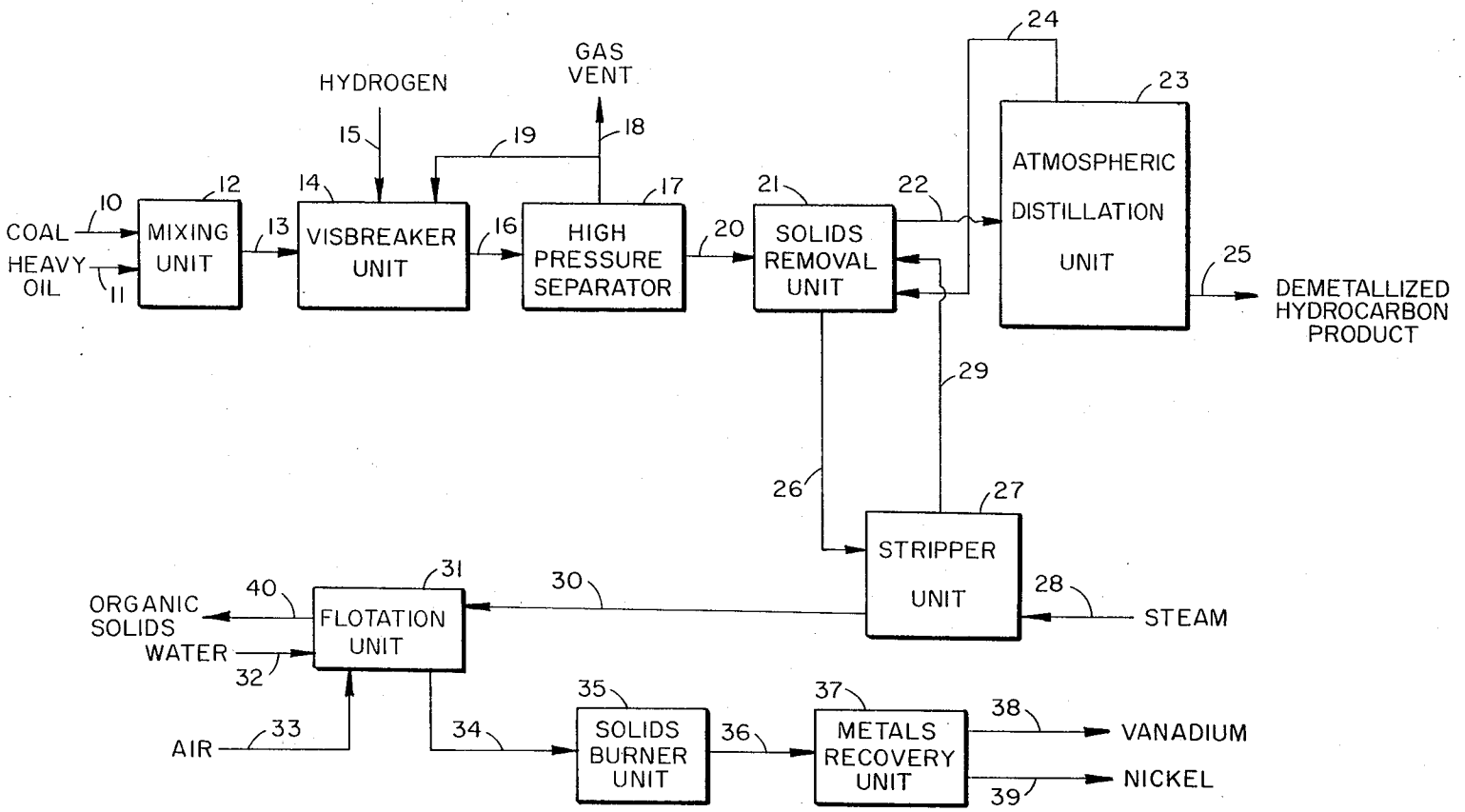
COAL
HEAVY OIL
MIXING UNIT
HYDROGEN
VISBREAKER UNIT
GAS VENT
HIGH PRESSURE SEPARATOR
SOLIDS REMOVAL UNIT
ATMOSPHERIC DISTILLATION UNIT
DEMETALLIZED HYDROCARBON PRODUCT
STRIPPER UNIT
STEAM
FLOTATION UNIT
ORGANIC SOLIDS
WATER
AIR
SOLIDS BURNER UNIT
METALS RECOVERY UNIT
VANADIUM
NICKEL
10
11
12
13
14
15
16
17
18
19
20
21
22
23
24
25
26
27
28
29
30
31
32
33
34
35
36
37
38
39
40

RECOVERY OF METAL VALUES FROM PETROLEUM RESIDUA AND OTHER FRACTIONS

BACKGROUND OF THE INVENTION

Cross Reference to Related Applications

This application is a continuation-in-part of my prior copending application, U.S. Ser. No. 340,661, filed Jan. 19, 1982, now abandoned, which is a continuation-in-part of my prior application Ser. No. 224,778, filed Jan. 13, 1981 and now U.S. Pat. No. 4,334,976, which in turn is a continuation-in-part of my patent application Ser. No. 186,927, filed Sept. 12, 1980 and now U.S. Pat. No. 4,317,711. The entire contents of all these applications are incorporated herein by reference.

FIELD OF THE INVENTION

The invention relates to thermal visbreaking of metals containing oils with coal, and recovery of the metal values.

PRIOR ART

Residual petroleum oil fractions produced by atmospheric or vacuum distillation of crude petroleum are characterized by a relatively high metals content. This occurs because substantially all of the metals present in the original crude remain in the residual fraction. Principal metal contaminants are nickel and vanadium, with iron and small amounts of copper sometimes present.

The high metals content of the residual fractions generally preclude their effective use as chargestocks for subsequent catalytic processing such as catalytic cracking and hydrocracking because the metal contaminants deposit on the special catalysts for these processes and cause the formation of inordinate amounts of coke, dry gas and hydrogen.

It is current practice to upgrade certain residual fractions by a pyrolytic operation known as coking. In this operation the residuum is destructively distilled to produce distillates of low metals content and leave behind a solid coke fraction that contains most of the metals. Coking is typically carried out in a reactor or drum operated at about 800°-1100° F. temperature and a pressure of 1-10 atmospheres. The economic value of the coke byproduct is determined by its quality, particularly its sulfur and metals content. Excessively high levels of these contaminants makes the coke useful only as low-valued fuel. In contrast, cokes of low metals content, for example up to about 100 ppm (parts per million by weight) of nickel and vanadium, and containing less than about 2 weight percent sulfur may be used in high-valued metallurgical, electrical, and mechanical applications.

At present, catalytic cracking is generally accomplished by utilizing hydrocarbon chargestocks lighter than residual fractions which usually have an API gravity greater than 20. Typical cracking chargestocks are coker and/or crude unit gas oils, vacuum tower overhead, and the like, the feedstock having an API gravity from about 15 to about 45. Since these cracking chargestocks are distillates, they do not contain significant proportions of the large molecules in which the metals are concentrated. Such cracking is commonly carried out in a reactor operated at a temperature of about 800°-1500° F., a pressure of about 1-5 atmospheres, and a space velocity of about 1-1000 WHSV.

The amount of metals present in a given hydrocarbon stream is often expressed as a chargestock's "metals factor". This factor is equal to the sum of the metals concentrations, in parts per million, of iron and vanadium plus ten times the concentration of nickel and copper in parts per million, and is expressed in equation form as follows:

$$F_m = Fe + V + 10(\mathrm{Ni} + \mathrm{Cu})$$

Conventionally, a chargestock having a metals factor of 2.5 or less is considered particularly suitable for catalytic cracking. Nonetheless, streams with a metals factor of 2.5-25, or even 2.5-50, may be used to blend with comparatively low metals content chargestocks or as all of the feedstock to a catalytic cracker, since chargestocks with metals factors greater than 2.5 in some circumstances may be used to advantage, for instance with the newer fluid cracking techniques.

In any case, the residual fractions of typical crudes will require treatment to reduce the metals factor. As an example, a typical Kuwait crude, considered of average metals content, has a metals factor of about 75 to about 100. As almost all of the metals are combined with the residual fraction of a crude stock, it is clear that at least about 80 percent of the metals and preferably at least 90 percent needs to be removed to produce fractions (having a metals factor of about 2.5-50) suitable for cracking chargestocks.

the economic and environmental factors relating to upgrading of petroleum residual oils and other heavy hydrocarbon feedstocks have encouraged efforts to provide improved processing technology, as exemplified by the disclosures of various U.S. patents which include U.S. Pat. Nos. 3,696,879; 3,775,303; 3,876,530; 3,882,049; 3,897,329; 3,901,792; 3,905,893, 3,964,995; 3,985,643; 4,016,067, and the like.

Some work has been reported in U.S. Pat. No. 4,298,456, on recovering the metal values in heavy oils by using a combination of solvent extraction followed by demetalizing the extract in a magneto-filtration step. Solvent extraction removes a significant portion of the metals together with almost all of the asphaltines, although leaving behind a significant metal content. For that reason, the extract, although deasphalted, is subjected to magneto-filtration. Such an approach should be effective in producing a demetalized product, although there will be a significant yield loss due to solvent extraction, and such an approach is expensive, both from a capital equipment standpoint and from an operating cost standpoint.

RELEVANT (But Not Prior) Art

Quite a lot of work on metals removal was reported, after I made my invention, in Canadian Pat. No. 1073389. The process reported therein had a number of drawbacks.

Basically, this patent taught thermal hydrocracking of bitumin, using various coals as "getters". This reference taught maintaining a fixed bed of coal in a thermal hydrocracking zone, or alternatively, adding relatively large coal particles to a thermal hydrocracking zone, wherein the particles presumably accumulate, and eventually dissolve, or perhaps attrite, and become sufficiently small in size that they are swept out of the reactor.

Such a process attempts to avoid problems of plugging or coking by operating with relatively high hydrogen partial pressures, at least 1,000 PSIG, and preferably 1,500 to 2,000 PSIG of hydrogen partial pressure. Even with such high pressures, there is a substantial amount of coking that goes on, as evidenced by the plugging or fusing together of the coal particles into a solid mass, having the dimensions of the reactor.

An appreciation of the severity of the process can be gained by examining the coke production thereof.

When operating at relatively low pressure, e.g., 500 PSIG, 14.6 weight percent of the feedstock was converted into coke, as reported in Table 13 of this reference. Increasing the pressure to 1,000 PSIG still resulted in production of 6.9 weight percent coke. At 2,000 PSIG, no coke was found in the reactor when coal particles were present, although operating without coal produced 3.1 weight percent coke.

The examples showed use of different kinds of coal as a getting agent. Coals ranging from semi-anthracite to lignite were tested. In general, the semi-anthracite did not remove much of the nickel and vanadium content of the feed, on the order of 15 to 20%. When semi-anthracite was used, the metals removed from the feed were largely recovered on the coal product, on the order of 80% of the metals removed from the feed were eventually obtained as part of the solid product.

When a lignite coal was used, much better metals removal was possible, on the order of 50% metals removal; however, only about 60% of the metals removed from the feed were recovered on the lignite.

One attempting to remove metals from a heavy resid fraction using the process disclosed in Canadian Patent 1073389 would be faced with the following problems:

1. Operation at 2,000 PSIG—requiring a significant increase in cost.

2. Good metals removal from oil using lignite, but poor recovery of metals on the lignite.

3. Poor removal of metals from the feed with semi-anthracite, but good recovery of metals removed on the anthracite.

One following the teachings of Canadian Pat. No. 1,073,398, would be given no guidance as to a way to optimize metals recovery from heavy, metals-contaminated crude oil stocks.

This patent looked on the metals in the feed only as undesirable poisons which must be removed-the only use that was suggested for the metal/coke/coal material removed from the reactor was burning to produce energy or gasification to produce hydrogen and fuel gas.

Very little guidance was given towards recovery of the solids from the coal/bitumin slurry. The only method disclosed in that patent of recovering solids was to take a bed of coal from a reactor and subject it to toluene extraction in a soxhlet apparatus, an ideal method of separating solids from liquids in a laboratory, but hardly suited to industrial use.

I discovered that many of the problems of the Prior Art Process could be overcome by avoiding thermal hydrocracking. Operating at much milder cracking conditions, in a processing scheme closer to visbreaking than any other process, and far removed from thermal hydrocracking, it was possible to handle the problem of coke formation without resorting to high-hydrogen partial pressure operation.

By operating a thermal visbreaking process with coal, I discovered that it was possible to not only remove much of the metals content from the feed, but recover the removed metals with the coal/coke product. Metals removal from the residual feed was accomplished at relatively low pressures, much lower than those required for hydrocracking processes. A further discovery was that it was possible to place the metal values removed from the crude in a chemical, and physical, state most susceptible to conventional metallurgical recovery techniques.

Employing my process, a substantial portion of the metal values present in the heavy hydrocarbon oil feed will be recovered in relatively concentrated form in the ash. Known and conventional procedures can thereafter be employed to recover the metal values at a cost which is competitive for the same metals obtained from common types of ores. Thus, for example, when high metal residua such as Boscan crude are used, an ash containing up to 5% by weight of vanadium pentoxide, $V_2O_5$, can be obtained in accordance with this process. This compares with one of the world's richest vanadium ores (Bushveld, South Africa) which contains about 1.5–2% by weight of vanadium pentoxide. The ash obtained by burning the solids product resulting from the practice of the present invention will also typically contain about 0.2% nickel (in combined form) which is comparable to the nickel content of the average grade ores in the United States.

BRIEF DESCRIPTION OF THE DRAWINGS

The drawing is a simplified block flow diagram of one embodiment of the present invention.

BRIEF SUMMARY OF THE INVENTION

Accordingly, the present invention provides a process for heavy hydrocarbon oil demetallation and metals recovery which comprises heating an admixture of 70 to 95 wt % heavy hydrocarbon oil containing at least one metal selected from the group consisting of vanadium and nickel and 5 to 30 wt % particulate coal under visbreaking conditions to produce a visbroken liquid with a reduced metals content containing solids; recovering from the visbroken liquid an oil fraction with reduced metal content and a solids fraction containing at least about 30% of the metal in said heavy hydrocarbon oil.

In another embodiment the present invention provides a process for demetallation of heavy hydrocarbon oil containing at least 50 ppm of metals selected from the group comprising vanadium and nickel, which process comprises heating an admixture of 75 to 85 wt % of said oil and 15 to 25 wt % particulate coal in a visbreaking reactor under visbreaking conditions which include a temperature of 800° to 950° F. and a weight hourly space velocity of about 1 to 100, and wherein said temperature and space velocity are sufficient to substantially reduce the viscosity of said oil while preventing coking of said feed to produce a visbroken liquid with a reduced viscosity and a reduced metals content but containing coal solids; recovering from said visbroken liquid an oil fraction with a reduced metals content and a solids fraction containing at least about 30 percent of the metal in said oil feed, and wherein at least a majority of the metals removed from said oil are recovered on said solids; and oxidizing said solids fraction to form a metal rich synthetic ore.

In still another embodiment the present invention provides a process for separating coal solids from heavy hydrocarbon oil comprising contacting said oil coal mixture with an antisolvent which will promote precipitation of a solids phase contaminated with heavy oil residue from an oil phase with a reduced solids content;

washing said precipitated solids with a wash solvent to obtain coal solids substantially free of heavy oil and a wash solvent fraction containing a minor amount of heavy oil; charging said wash solvent containing a minor amount of said heavy oil to the solvent contacting zone.

DESCRIPTION OF THE PREFERRED EMBODIMENTS

The term "heavy hydrocarbon oil" is meant to include petroleum oil residua and tar sand bitumen feedstocks, in which mixtures at least 75 weight percent of the constituents have a boiling point above about 700° F.

Typically a heavy hydrocarbon oil suitable for treatment in accordance with the present invention has a metals content of at least 80 ppm, and a Conradson Carbon Residua content of at least 10 weight percent.

The coal component of the invention process can be any of a variety of carbonaceous materials which include bituminous and sub-bituminous types of coal, lignite, peat, and the like. The nominal analysis of typical coals are as follows:

| | |
|---|---|
| Sub-Bituminous | |
| Sulfur | 0.21% |
| Nitrogen | 0.88 |
| Oxygen | 15.60 |
| Carbon | 65.53 |
| Hydrogen | 5.70 |
| Ash | 3.99 |
| Lignite | |
| Sulfur | 0.53% |
| Nitrogen | 0.74 |
| Oxygen | 32.04 |
| Carbon | 54.38 |
| Hydrogen | 5.42 |
| Ash | 5.78 |

Ball mills or other types of conventional apparatus may be employed for crushing and pulverizing coarse coal in the preparation of the particulate coal feed for the visbreaking step (a) of the process. The crushing and grinding of the coal can be accomplished either in a dry state or in the presence of a liquid such as the heavy hydrocarbon oil being employed in the practice of the invention process. The average particle size of the coal feed is preferably below about 0.25 inches, such as finely divided bituminous coal which has a particle size of less than about 3 mesh (U.S. Sieve Series).

The oil and coal are slurried in a mixing zone and pumped through a visbreaking reaction zone. The weight ratio of heavy hydrocarbon oil to coal is in the range between about 2.5–20.

VISBREAKING CONDITIONS

A detailed discussion of visbreaking conditions is included in my U.S. Pat. No. 4,379,747, the entire contents of which is incorporated herein by reference.

The visbreaking heat treatment is conducted at a temperature between about 800°–950° F., and at a weight hourly space velocity between about 1–100.

The visbreaking operation maximum severity is set primarily by the long term storage stability of the visbroken liquid. Normally, I would limit visbreaker severity so that the visbroken liquid product, after solids removal, has a low toluene insoluble content. The toluene insoluble content of the liquid product of my process should always be less than 2 wt %, and preferably is less than ½ wt %.

In an over simplified way, the minimum and maximum visbreaker severity may be summarized as follows.

The visbreaker conditions must be severe enough to reduce viscosity and promote the demetallation reaction. Tests showed that ground up coal did not remove metals from a resid at room temperature, even after days of stirred contact with toluene added to dilute the resid.

Operation with somewhat too severe visbreaking conditions will lead to increased demetallation, some conversion of the resid feed to lighter, distillable products, and a heavy liquid that is unstable in storage because it contains too much toluene insolubles. Such an operation may be ideal when long term storage of heavy product is not contemplated and there is a demand for some lighter products or maximum demetallation.

Very severe visbreaking, or an operation approaching coking, should be avoided. The visbreaker reactor would be plugged by coke deposits, and the liquid product would be very unstable.

An advantage of the present invention is that it permits demetalation to occur during visbreaking at mild conditions, even in the absence of hydrogen.

It is possible to conduct the visbreaking heat treatment under a hydrogen partial pressure, between about 10 to 1000 PSIA, but high $H_2$ pressures are not needed. Addition of steam to the level of about 0.1–5 weight percent of the combined charge stock may be advantageous. I prefer to operate the entire visbreaking process in liquid phase, though a small vapor phase may be present.

Demetallation occurs at the incipient temperature of coking for the heavy hydrocarbon oil, i.e., a temperature above about 800° F. and above thermal conversion of the heavy hydrocarbon oil yields light distillates. Any coke which is coproduced effectively traps the metal components in the heavy oil and becomes incorporated in the surrounding matrix of coal and ash particles.

Simultaneously, coal depolymerization occurs with the production of gas and liquid constituents. The heavy hydrocarbon oil is a polycyclic aromatic hydrocarbon component which can function as a solvent to convert at least a portion of the coal to liquid constituents.

The visbreaker effluent is passed through a high pressure separator to vent the light end constituents. If hydrogen gas is present, the gas mixture is at least partially recycled to the visbreaking zone. Alternatively, the gas mixture can be fractionated to recover the hydrogen gas for recycle.

The degassed visbreaker effluent is subjected to solids removal treatment. Solids removal may be accomplished by, e.g., filtration or use of a high temperature settler. This separation operation can be facilitated by use of a light solvent or antisolvent, preferably the latter. In addition, use of solvent makes it possible to carry out this solid removal at lower temperatures. It is preferred that the solids removal zone is a liquid-liquid countercurrent contacting system.

Suitable solvents for use in the solids removal step include liquefied normally gaseous hydrocarbons such as ethane, ethylene, propane, propylene, n-butane, isobutane, n-butylene, isobutylene, pentane, and isopentane; cyclohexane; hexane; heptane, decane; octane; nonane; decalin; and mixtures thereof. In terms of streams available in refineries, the useful solvents are light and heavy naphthas, (including straight run, coker and catalytic cracked) naphthas and kerosenes. The yield of liquid products extracted in the deasphalting operation can be increased if a light $C_6$–$C_{16}$ aromatic solvent is employed, e.g., benzene, toluene, xylene, mesitylene, naphthalene, and the like. In general, the solvent of choice is a liquid hydrocarbon containing between about 3–12 carbon atoms.

The weight ratio of solvent to visbroken admixture normally will be in the range between about 0.05–5:1.

Solids removal preferably is conducted at a temperature between about 100°–500° F. and at a sufficient pressure to maintain the solvent in liquid form, and for a period between about 0.1–1.5 hours.

The liquid solvent extract phase and the precipitated solids are withdrawn separately from the deasphalting zone. The solvent-oil effluent is charged to an atmospheric distillation tower to strip off the solvent. The distillation bottom fraction is a substantially demetallized liquid hydrocarbon product. The metals content of the liquid hydrocarbon product is less than about 50 ppm.

The yield of demetallated liquid will be about 45–90 weight percent of the total weight of heavy hydrocarbon oil and coal (m.a.f.) fed into the processing system.

The solids product will usually equal about 10 to 90 wt % of solids added to the system. The solids may be cleaned up by steam or solvent stripping.

Each of these unit operations will be discussed in more detail hereafter.

SOLIDS/VISBREAKER LIQUID SEPARATION

The amount of precipitated solids (coal, coke) will vary depending on the amount and type of coal added, and visbreaking severity. Coal solid and visbreaker liquid properties, and capital constraints, will influence which type of solids/liquid separation scheme is best for a given unit. Separation treatments range from a simple settler to more complex methods, such as deasphalting.

SOLIDS SETTLER

In its simplest form, the visbreaker effluent containing coal will be sent to a hot settler. The settler must be run at a fairly high temperature to keep the viscosity of the liquids contained therein relatively low to permit efficient settling. the minimum temperature in the hot settler must be above that of the pour point of the material contained in the hot settler. If no solvent is present, temperatures of 100° to 300° may be necessary to achieve a low enough liquid viscosity in the settler to achieve good solids/liquids separation. An upper limit on temperature in the hot settler is the coking temperature of the material contained in the settler. The hot settler is not a delayed coker, although it is acceptable, and may be desirable, to allow a portion of the visbreaking reaction to occur in the hot settler. It also may be economically desirable to settle for a very poor separation of solid/liquid in the hot settler, i.e., accomplishing in the hot settler only that solids separation which is readily achieved. The advantage of this approach is that very large coal/coke particles can be removed in the hot settler and be recycled or treated separately from relatively smaller coal particles. This approach acts as insurance against large lumps or particles of coal entering, and damaging, downstream processing equipment. This approach also allows some flexibility in processing two different particle streams, a relatively large particle stream with a high heating value but low metal content, and a relatively small particle coal/coke product with a higher metals content.

It is also possible, and may be the optimum approach in some circumstances, to operate with a relatively cool settler, with reduction in liquid viscosity by addition of a solvent or diluent.

It is also possible to combine these approaches, i.e., operation with a limited amount of solvent and relatively high temperature, so long as the amount of solvent, and the temperature, are adjusted to maintain suitable liquid viscosity to permit rapid settling of solids from heavy liquids.

ANTI-SOLVENT ADDITION

When a more complete separation of solids from liquids is desired, and especially when it is desired to substantially upgrade the liquid product, treatment of visbreaker liquid with a selected solvent or antisolvent will be helpful.

Treatment of hot visbreaker effluent at relatively low temperatures, on the order of 30 to 100C, with a selective solvent such as a light aromatic material, preferably benzene, toluene, xylene, or mixture thereof, does a good job of separating liquid products and leaving behind a solid product which is not tacky.

It is possible to use even heavier aromatic-rich solvents, and use of such materials will help increase, slightly, liquid yields, although subsequent solvent recovery from liquid product will be made somewhat more difficult because of the use of heavier solvent.

It is possible to obtain a significant improvement in product quality by the use of a relatively light aliphatic solvent, or more properly, antisolvent. Use of, e.g., normal hexane antisolvent for treatment of visbreaker liquid will remove not only all of the coal solids present in the liquid, but will condense and precipitate all of the heptane insoluble materials, primarily asphaltics, along with coal. Removal of heptane insolubles from the liquid product significantly upgrades the visbreaker liquid, as far as viscosity, metals content and heptane insoluble content is concerned, although the liquid yield will be diminished to some extent.

It is possible to go to a relatively severe antisolvent treatment, by use of a lighter antisolvent such as propane. Propane deasphalting of visbreaker liquid will provide a visbreaker product that is cleanest in terms of low asphaltic content, however the use of propane deasphalting is not preferred as the loss in liquid yield is too great, and also because the solids contamination with asphaltic materials is excessive.

In some circumstances, it may be desirable to use a relatively severe antisolvent treatment, producing a very clean oil stream, and a relatively dirty solids stream, and subject the solid stream to additional treatment steps to remove trace amounts of residual oil, light asphaltics, etc. from the coal solids contained in the visbreaker effluent.

Conditions used for antisolvent treatment of the visbreaker liquid are conventional, typically involving temperatures of 30°–100° C., and pressures sufficient to maintain a liquid phase.

PRODUCT FRACTIONATION

Another way of separating coal solids from visbreaker liquid is to subject all or a portion of the visbreaker effluent liquid to distillation. Distillation can be used to remove distillable liquids from the coal/liquid visbreaker effluent.

Because the visbreaker is operated at relatively mild conditions, not very much distillable material is generated in the visbreaker. Typically a minor portion of the coal, is converted to gases, and a minor portion, perhaps approaching a major portion, of the coal is converted to liquids, but most of these liquids are relatively heavy and cannot be easily distilled.

Hot visbreaker effluent liquid, either before or after passage through a hot settler, can be subjected to distillation in conventional distillation equipment, operated at pressures ranging from subatmospheric to a few atmospheres. If distillation of visbreaker effluent liquid is practiced, care must be taken to design the column so that the presence of large amounts of coal solids will not plug up the column. Such a column design is commonly used in FCC units, in the main column, wherein significant amounts of catalyst fines are present in the liquid charged to the distillation column.

SOLVENT RECOVERY

Regardless of the reason for adding a solvent, whether to reduce viscosity, promote solids precipitation, or to wash oil from precipitated solids, it is usually desirable to incorporate one or more solvent recovery steps into the process.

Solvent recovery from extract oil is relatively straight forward, and any conventional means of recovering a light solvent from a heavy liquid may be used. This can be one or more flash chambers, or distillation chambers, or any other conventional means of recovering solvent from a heavy liquid. Simple distillation or solvent stripping is preferred, at relatively low pressures ranging from a few atmospheres to vacuum conditions to promote removal of light solvent. Temperature of solvent stripping will be sufficient to vaporize the relatively light solvents from the heavy liquid. When, e.g., a light naphtha is used as a solvent temperatures of 150°-225° will usually be sufficient to remove enought of the light ends.

The heavy solids phase, or solids-rich liquids phase obtained when an antisolvent is added, should also be treated to recover solvent for reuse. This separation is theoretical because of the great difference in boiling points, however the higher viscosity and presence of solids complicate solvent recovery. Provision should be made to accommodate higher temperature operation, to keep the solids, or solids-rich liquid phase in a condition to facilitate handling.

All solvents used will not necessarily be the same, nor even serve the same purpose. Depending upon local economics, it may be desirable to add a small amount of solvent A to a hot settler to act as a thinner, to produce a solids-rich phase containing a small amount of oil and solvent A, and a liquid phase with a reduced, but still substantial solids content and most of the solvent A that was added.

Both of these streams, the solid and liquid streams, could be treated further with solvents. The solids might be washed with solvent B, for example, a hot naphtha to remove traces of oil from the relatively large particle size solids.

The liquid phase from the hot settler, with or without removal of solvent A, could be treated with solvent C, preferably an antisolvent, to complete removal of particulate matter, and asphaltic materials, from the liquid product.

The same solvent may serve double duty. The wash solvent B, after cleaning the solids, may be used as a portion of the antisolvent C to precipitate asphaltics from visbreaker liquid.

Each of the individual solvent treatment stages could be broken down into substages, e.g., the antisolvent treatment step could comprise a series of treatments. The first treatment might be with a relatively high molecular weight antisolvent, followed by a treatment with a lower molecular weight antisolvent to obtain some fractionation of the solids and asphaltic materials precipitated from the liquid.

STEAM STRIPPING

Another upgrading treatment that may be applied to the solids is steam stripping. The ideal application of steam stripping is to remove oil present on the coal/-precipitated solids. Steam stripping may also be used to facilitate solvent recovery from the solids fraction and simultaneously remove strippable oils from the coal/-precipitant product.

When steam stripping is practiced, the amount of steam used relative to the amount of product treated will be relatively small, on the order of 1 to 10 wt %. Preferably from 3 to 6 wt % steam is added to a stripping vessel for steam stripping.

SOLIDS TREATMENT

The solids fraction, with or without stripping to remove adsorbed solvent and oil, is processed to provide a metals-rich ash in any number of ways. The asphaltic solids can be burned to contribute to the thermal operating requirements of the refinery, a petrochemical plant or other industrial facility, the metals-rich ash being recovered for recovery of metals therefrom. To facilitate recovery of metal, the ashphatic solids should be burned at temperature lower than the ash fusion temperature of the coal, i.e., about 2000° F. or lower. To affect this combustion, fluidized bed combustion is preferred.

FLOTATION FRACTIONATION OF SOLIDS

To improve the efficiency of metal recovery, the asphaltic solids can be beneficiated first. The powdered asphaltic solids are treated under flotation conditions in an aqueous medium to yield a float phase of organic solids product which has been separated from a sink phase of inorganic ash rich in metals, the latter being subjected to burning in order to eliminate any associated organic matter.

The flotation of the organic solids product is facilitated by air-frothing, particularly in combination with flotation aids such as ionic and nonionic surfactants, and the like. A suitable apparatus for solids fractionation is disclosed in U.S. Pat. No. 4,222,857, the entire contents of which is incorporated by reference.

The organic solids product on the average constitutes between about 10-50 weight percent of the total weight of heavy hydrocarbon oil and coal (m.a.f.) fed into the processing system. The organic solids product will contain about 10 to 40% of the total metal content in the total solids produced by deasphalting. The inorganic sink phase will contain about 60 to 90% of the total metal content. The weight ratio of solids in the organic/sink phase separation will be 0.5 to 2.

SOLIDS BURNER

Any known, or hereafter developed, solids burner may be used to burn the solids product of the present invention, though not necessarily with equal results.

For best results, it is important to limit the combustion temperature below the fusing point of the solids being burned. Operation with temperatures above this point will produce metal values in an oxide form, but which are encased in slag. The slag is relatively impermeable to most acids and solutions used to recover metal values from ore, and slag formation should be avoided when metals recovery is desired.

Fluid bed combustion of the coal solids produced in the present invention is believed to be the ideal way to both recover the heating value of combustable material contained in the coal/solids product, and also to obtain metal values in an oxidized form which is amenable to further hydrometallurgical processing.

The temperature within the preferred fluid bed combustion zone may be controlled by limiting the amount of oxygen or oxygen-containing gas admitted therein, or by provision of heat removal means, e.g., heat exchanger tubes, within the fluid bed combustor. Alternatively, a gas, or dense or dilute phase coal/solid product may be passed over heat exchange means external to the fluid bed combustion zone. The heat of coal combustion can be recovered either as high pressure steam, or used to preheat various streams associated with the process, e.g., visbreaker feed.

Depending on the design of the coal burner, and on local economics, it may not be very important to remove all of the oil and/or solvent clinging to the coal solids. As long as the oil, or flammable solvents if solvents are used, is added to the combustion zone, the energy contained in these streams will be recovered as heat. Materials handling of the coal solids product of the present invention will be materially aided if the solids are maintained as a slurry of solids in either oil or solvent, or as a slurry of solids in water. When flotation fractionation of solids is practiced, it may be desirable to provide different combustion zones for the organic solids product and the inorganic ash rich sink phase.

Vanadium recovery can be promoted by the addition of sodium carbonate to the fluid bed combustion zone. The sodium carbonate will fuse with the vanadium compounds formed or present in the solids combustion zone to form sodium vanadate.

METALS RECOVERY

Once an oxidized solid product is obtained, it may be subjected to conventional metals recovery techniques. Metals recovery will be facilitated in the process of the present invention because the solids product will be oxidized, in relatively uniform and small particle size, and be very concentrated in metals values.

When nickel is present, it may be leached from the oxidized particulate matter obtained from coal combustion by contacting the oxidized product with ammonium sulfate solution. The ammonium sulfate forms a complex with nickel, which may be subjected to further conventional processing to recover nickel values therefrom.

The vanadium compounds present, preferably sodium vanadate, may be leached with various acid streams, e.g., relatively dilute or concentrated mineral acids such as HCl, etc., to form an acid stream containing vanadium compounds. These aqueous streams may be subsequently purified to produce relatively pure $V_2O_5$ product.

Illustrative of the invention process, the drawing is a schematic representation of visbreaking, solids removal, flotation, burning and metals recovery in series for co-processing of heavy hydrocarbon oil and coal, with recovery and recycle of solvent to the solids removal unit.

Referring to the drawing, coal is charged through line 10 and heavy hydrocarbon oil is charged through line 11 into mixing unit 12 where they are admixed to form a slurry.

The coal is a high volatile A bituminous stock which has been ground to a particle size of about 50 mesh. The coal has the following elemental analysis:

| | |
|---|---|
| Sulfur | 1.33% |
| Nitrogen | 1.63 |
| Oxygen | 7.79 |
| Carbon | 80.88 |
| Hydrogen | 5.33 |
| Ash | 2.77 |

The heavy hydrocarbon oil is an Arabian light vacuum residual fraction which has the following analysis:

| | |
|---|---|
| API, gravity | 8.3 |
| H, wt. % | 10.67 |
| S, wt. % | 3.93 |
| N, wt. % | 0.28 |
| CCR, wt. % | 16.13 |
| V, ppm | 68 |
| Ni, ppm | 17 |
| MW | 810 |

The oil-coal slurry admixture is withdrawn from mixing unit 12 and pumped through a preheating unit and passed into visbreaker unit 14 via line 13. The weight ratio of oil to coal is about 2:1, and the weight hourly space velocity of the oil-coal is about 20.

Hydrogen enters visbreaker unit 14 through line 15 to provide a hydrogen partial pressure of about 600 psig in the visbreaking zone at a temperature of about 825°-850° F. Visbreaker 14 operates in the liquid phase, the small amount of hydrogen added will not produce a significant vapor phase. Visbreaker 14 will operate well with no hydrogen addition, or may operate as shown, with some hydrogen addition. Steam addition may also be practiced.

Hydrogen consumption due to visbreaking is minimal, estimated to be about 5-10 SCFB. $H_2$ consumption due to coal liquifaction in visbreaker 14 is estimated to about 10-20 SCFB.

The visbreaker effluent is passed through line 16 to high pressure separator 17 where a gaseous fraction is vented through line 18. A portion of the hydrogen-rich gas is recycled to visbreaker unit 14 via line 19.

The degassed visbreaker effluent is transferred through line 20 to the top section of solids Removal Unit 21. This could be a settler, supercritical extractor, etc., but in the embodiment shown, is an extractor. Effluent flows downward in countercurrent contact with a light solvent such as heptane. It is preferred, however, to employ an anti-solvent for this purpose. The term "anti-solvent" is meant to include a light paraffinic hydrocabon such as n-pentane or n-hexane which serves to increase the precipitation of the ash solids and to increase the sedimentation rate by agglomeration of fine particles. The anti-solvent is commonly employed in a quantity between about 1–200 weight percent and 5–100% is preferred, based on the weight of the oil phase.

The weight ratio of light solvent to visbroken admixture in the solids removal zone is maintained at about 1:1, with the temperature being at about 300° to 600° F. and the pressure at about 600 psig. The liquid-liquid contact time in the solids removal zone is about 10 minutes.

A liquid oil fraction of light solvent soluble hydrocarbon constituents exits from the top of solids removal unit 21 and is passed through line 22 to atmospheric distillation unit 23. Solvent is recovered from the distillation column and recycled via line 24 to solids removal unit 21.

Demetallized liquid hydrocarbon product is withdrawn from the processing system via line 25.

Precipitated solids are withdrawn from solids removal unit 21 through line 26 and entered into stripper unit 27. The solids contain small quantities of unreacted coal and inorganic ash.

Steam is fed into stripper unit 27 through line 28 to remove residual light solvent and oil from the solids. The stripped liquid hydrocarbons are recycled through line 29 to solids removal unit 21.

The stripped solids are removed from stripper unit 27, mechanically crushed to a fine powder and transferred via line 30 to flotation unit 31. Water is supplied to flotation unit 31 through line 32 and air is supplied through line 33. Optionally, a small quantity of No. 2 oil is added to the aqueous medium in flotation unit 31 to facilitate the flotation of organic solids product.

An inorganic ash sink phase is withdrawn from flotation unit 31 through line 34 and is introduced into solids burner Unit 35. An organic solids float phase is removed from the processing system via line 40.

Solids burner unit 35 is preferably a fluidized bed combustor so as to minimize the peak temperature to below the ash fusion temperature. When operating with high volatile A bituminous coal, the temperature is preferably limited to 1300° C. It is beneficial, in some instances, to add chemicals such as sodium carbonate to the fluid bed combustor to facilitate the subsequent step for recovery of metals values from the ash produced in the combustor. The heat released during combustion can be used, for example, to generate steam for the operation of other plant facilities. Metals-rich ash is recovered from unit 35 and conveyed through line 36 to metals recovery unit 37 where the metals (vanadium through line 38 and nickel through line 39) are recovered employing known and conventional procedures. For example, the nickel can be leached with $(NH_4)_2SO_4/NH_4OH$ solution as $Ni(NH_3)_6SO_4$ complex. The sodium vanadate can be leached with $H_2SO_4$.

EXAMPLES

Employing the process of this invention, a series of runs were carried out with the varying feeds, the properties of which are set forth in Table 1 as follows:

TABLE I

| RESIDUAL OIL PROPERTIES | Arabian Light | Joliet | Boscan |
|---|---|---|---|
| API Gravity | 8.3 | 6.1 | 10 |
| H, wt % | 10.67 | — | — |
| S wt % | 3.93 | — | 5.5 |

TABLE I-continued

| RESIDUAL OIL PROPERTIES | Arabian Light | Joliet | Boscan |
|---|---|---|---|
| N wt | 0.28 | | 0.58 |
| CCR wt % | 16.13 | 19 | 160 |
| Asphaltenes, wt % | — | 9.2 | 8.0 |
| V, ppm | 68 | 250 | 12.20 |
| Ni ppm | 17 | 53 | 106 |
| Mw | 810 | — | — |

Examples 1–7

The visbreaking process of the present invention was tested in Runs 1–7, corresponding to Examples 1–7. The experimental apparatus used was a $\frac{3}{8}$" OD × 1 ft stainless steel reactor equipped with a means of feeding, heating, pressure control, product recovery and gas sampling. No attempt was made to upgrade or treat the solid residue, other than steam/solvent stripping.

VISBREAKING PROCEDURE

In a typical experiment the following procedure was followed. After the unit was pressurized to the required pressure with nitrogen, the furnace was switched on and the reactor was allowed to reach the required temperature. The feed pump was started and was allowed to run until the required amount of feed was processed.

After the system pressure was reduced to atmospheric, the product receiver was removed from the system and heated to 70° C. Hot material was then allowed to drain from the bottom of the receiver. Toluene was then added to the receiver to remove soluble material. This mixture was then drained and fresh toluene was added to the receiver until it was washed clean. Drained material and toluene washes were combined and the mixture was filtered through #42 paper on a Buchner funnel. The solid product was then washed with additional toluene until it was no longer tacky. In small scale experiments, the solid product was washed with toluene until the filtrate became clear. Larger amounts were extracted with toluene in a Soxhlet. Clean solid product was dried in a vacuum oven at 110° C. and filtrate was stripped at 70° C. in the Rotavap to remove the solvent.

Results are reported in Table II.

TABLE II

VISBREAKING OF RESID/COAL SLURRY
METAL IN SOLID RESIDUE pressure, psig 400
$pH_2$psia —
LHSV, v/vhr: 12

| | Run. No. 1 | 2 | 3 | 4 | 5 | 6 | 7 |
|---|---|---|---|---|---|---|---|
| Oil | Joliet 503342 | | | | | Boscan | |
| Coal | Illinois #6; 6694 | | | | | Illinois #6; 6694 | |
| wt. % | 0 | 5 | 10 | 20 | 30 | 20 | 30 |
| Visbreaking Temp. [°C.] | | | | 465° C. | | 480 | |
| Yield, wt. % | | | | | | | |
| Gas | 1 | 2.8 | 3.4 | 3.9 | 4.3 | | |
| Liquid | 99 | 96.1 | 92.5 | 86.6 | 79.5 | | |
| Solid | 0 | 1.1 | 4.1 | 9.5 | 16.2 | | |
| Coal Conversion % | — | 78 | 59 | 53 | 46 | | |
| % Coal Solubilized | — | 41 | 34 | 37 | 34 | | |
| % Coal to Gas | — | 37 | 25 | 16 | 12 | | |

TABLE II-continued

VISBREAKING OF RESID/COAL SLURRY
METAL IN SOLID RESIDUE pressure, psig 400
$pH_2$psia —
LHSV, v/vhr: 12

| | Run. No. | | | | | | |
|---|---|---|---|---|---|---|---|
| | 1 | 2 | 3 | 4 | 5 | 6 | 7 |
| Oil | Joliet 503342 | | | | | Boscan | |
| Coal | Illinois #6; 6694 | | | | | Illinois #6; 6694 | |
| wt. % | 0 | 5 | 10 | 20 | 30 | 20 | 30 |
| % Demetallation | | | | | | | |
| Ni, ppm | 0 | 6 | 21 | 36 | 40 | 43 | 45 |
| V, ppm | 0 | 11 | 26 | 40 | 46 | 46 | 51 |
| Solids | | | | | | | |
| Ni, ppm | | 195 | | 130 | 80 | 155 | 210 |
| V, ppm | | 905 | | 535 | 225 | 1880 | 1690 |

Runs 1 to 5 show that the metal contents of the solids increase approximately linearly as the coal concentration is decreased. Since in the range of 20–30 wt. % coal, the degree of demetallation does not increase proportionally with coal concentration, a higher metal solid is obtained when the coal concentration is decreased. Decrease in coal concentration does decrease total demetallation to some extent. There would therefore appear to be an optimum coal concentration from the viewpoints of resid demetallation and metal recovery efficiencies. Runs 6 and 7 show that high metal solids can be obtained if a high metals content crude such as Boscan is used. By decreasing coal concentration, a solid with 4000 ppm of V can be obtained. Upon combustion of this solid, the ash will contain 2.5% V (5% $V_2O_5$) from which the metal values can be readily recovered in a known manner.

Example 8

More tests were conducted using Joliet vacuum residue and Illinois No. 6 coal (particle size less than about 2 microns). The intent was to vary the amount of coal added to the visbreaker feed to determine if both metals removed and metals recovery could be optimized.

The visbreaker unit is a ⅜ inch O.D.×one foot stainless steel reactor equipped with feeding, heating, pressure control, gas sampling and product recovery means.

Tables III and IV summarize the results of visbreaking heat treatment at 850° F., 400 psig and 12 LHSV, and Table V summarizes the results obtained when the heat treatment is conducted at 870° F., 400 psig and 12 LHSV.

The data in Tables III and IV demonstrate the degree of metals removal from a heavy hydrocarbon oil achieved with a process in accordance with the present invention. The results in Table V indicate that heat treatment at a higher temperature (e.g., 870° F.) increases the metals removal from a high metals content hydrocarbon oil such as a vacuum residuum.

TABLE III

| | | | | | | |
|---|---|---|---|---|---|---|
| Coal, % Wt | 0 | 5 | 10 | 20 | 30 | 100 |
| Joliet Residue % Wt | 100 | 95 | 90 | 80 | 70 | 0 |
| Properties | | | | | | |
| Gravity, °API, 60/60° F. | 6.1 | — | — | — | — | — |
| Conradson Carbon Residue (CCR), % Wt | 19 | — | — | — | — | — |
| Asphaltenes, % Wt | 9.2 | — | — | — | — | — |
| Viscosity, cS at, | | | | | | |
| 130° F. | 271,715 | — | — | — | — | — |
| 212° F. | 2,342 | — | — | — | — | — |
| Nickel, ppm* | 53 | 54 | 54 | 55 | 57 | 65 |
| Vanadium, ppm* | 250 | 238 | 227 | 205 | 181 | 20 |
| Ash, % Wt | 0.1 | — | — | — | — | 10 |
| Liquid Product | | | | | | |
| Gravity, *API, 60/60° F. | 5.7 | 5.7 | 5.7 | 6.2 | 7.6 | — |
| Asphaltenes, % Wt | 15.2 | — | — | — | — | — |
| CCR, % Wt | 19 | — | 19 | 19 | 18 | — |
| Viscosity, cS at | | | | | | |
| 130° F. | 622 | — | — | — | — | — |
| 212° F. | 112 | — | — | — | — | — |
| Nickel, ppm | 53 | 50 | 42 | 34 | 32 | — |
| Vanadium, ppm | 243 | 216 | 181 | 146 | 131 | — |
| Solid Product | | | | | | |
| Nickel, ppm | — | — | 135 | 130 | 80 | 65 |
| Vanadium, ppm | — | — | 495 | 535 | 225 | 25 |

*Calculated for the mixtures.

TABLE IV

| | | | | | |
|---|---|---|---|---|---|
| Coal, % Wt | 0 | 5 | 10 | 20 | 30 |
| Residue, Wt % | 11 | 95 | 90 | 80 | 70 |
| Yield, % Wt | | | | | |
| Gas | 1 | 2.8 | 3.4 | 3.9 | 4.3 |
| Liquid | 99 | 96.1 | 92.5 | 86.6 | 79.5 |
| Solid | 0 | 1.1 | 4.1 | 9.5 | 16.2 |
| Coal Conversion % | — | 78 | 59 | 53 | 46 |
| % Coal Solubilized | — | 41 | 34 | 37 | 34 |
| % Coal to Gas | — | 37 | 25 | 16 | 12 |
| % Demetallation | | | | | |
| Nickel | 0 | 6 | 21 | 36 | 40 |
| Vanadium | 0 | 11 | 26 | 40 | 46 |

TABLE V

| | | |
|---|---|---|
| Coal, % Wt | 20 | 30 |
| Residue, % Wt | 80 | 70 |
| Liquid Product | | |
| Gravity, °API | 5.7 | 5.7 |
| Asphaltenes, % Wt | — | 17 |
| CCR, % Wt | 19 | 19 |
| Nickel, ppm (%)* | 29 (45) | 25 (53) |
| Vanadium, ppm | 120 (52) | 67 (73) |
| Solid Product | | |
| Nickel, ppm | — | 110 |
| Vanadium, ppm | — | 360 |

*Data in parentheses represent extent of demetallation of processed Joliet vacuum residue.

From these data it can be seen that operation with about 5 to 30, and preferably about 15 to 25 wt % coal addition to visbreaker feed provides optimum metals removal and recovery.

Operation with relatively low amounts of coal addition, such that the coal comprises only 5–10 wt. % of the coal residue mixture fed to the visbreaker, provides a coal with relatively high metals content, with relatively low demetalation of resid, ranging from 6–21% removal of nickel to 11–26% removal of vanadium content of the resid.

Operation with very high coal levels, e.g. 30 wt % coal added and higher, gives good demetalation of the residual feed, but the solid coal/coke product contains a lower metals content, making metals recovery somewhat more difficult. Operation with a coal/residual slurry containing 30 wt. % coal produced a solid product containing 80 wt. ppm nickel, and 225 wt. ppm vanadium.

Operation with a coal/residue slurry, containing 20 wt. % coal, gave very efficient demetalation, equal to about 90% of the demetalation obtained when 30 wt. % coal/resid slurry was fed to the hydrotreater. Surprisingly, the vanadium content of the solid product of the process of the present invention was highest when only 20 wt. % coal was added to the coal/residual slurry. The nickel content of the solid product obtained when a 20/80 coal/resid feed was used, was almost the equal of that obtained when only half as much coal was added.

In going from 10 wt. % coal addition to 20 wt. % coal addition, the metals loading on the solid product, expressed as weight ppm metal on solid, remained practically unchanged, while demetalation of the resid increased.

This was unexpected. I expected demetalation of resid to increase with increased coal addition, but thought the metal loading of the solid product would decrease.

The metal loading of the solid product decreased when the amount of coal in the coal/resid slurry increased from 20 wt. % to 30 wt. %. Somewhat surprisingly, increasing the amount of coal added from 20 wt. % to 30 wt. % did not result in a significant increase in demetalation of the resid. Increasing the amount of coal by 50% (from 20 wt. % to 30 wt. % coal addition to the visbreaker feed) increased the amount of nickel removal only about 11% (from 36% demetalation to 40% demetalation).

Based on my experiments, I plotted the weight percent of added coals in the slurry vs. the logrithum of the concentration of vanadium in the recovered solid. This plot gave a straight line for both the Joliet vacuum residue and for Boscan crude.

The vanadium content of the solid residue could be correlated with the percent added coal, in the 5–30 wt. % range, to obtain the following equation:

$$M_s = -0.023 + 1.258 \log A$$

where $M_s$ is the vanadium content of the solid residue

Alpha is weight % added coal.

A is the vanadium concentration of the heavy oil feed to the visbreaker.

There are some limits to the applicability of this equation. It has only been tested in the range of 5 to 30 weight % coal addition. It implies that solids formation or coke formation from the heavy resid added to the visbreaker is negligible. The equation would not predict what would happen if the coal/residual oil slurry were charged to a conventional coking unit, because then coke formation would provide an additional mechanism for metal removal, and also result in additional solids being present. Simply coking the residual feed, with no coal present at all, would result in a solid with an extremely high vanadium content. Operation without coal to produce 4% solids or coke would give a solid containing 1,300 ppm vanadium. This equation is not, therefore, designed to predict metals level on coke obtained by thermal coking.

Example 9—Heptane Deasphalting

To produce a premium quality liquid product with greatly reduced metal content, a visbreaker residue was subjected to n-heptane deasphalting. Deasphalting conditions were conventional.

TABLE 6

Heptane Deasphalted Liquid Product Obtained From Coprocessing Joliet Vacuum Residue With 30% Illinois #6 Coal (870° F., 400 psig, 12 LHSV)

| | Heptane Solubles | Heptane Insolubles |
|---|---|---|
| % Wt to Liquid Product | 83 | 17 |
| Nickel, ppm | 10 | 120 |
| Vanadium, ppm | 32 | 470 |
| Elemental Analysis, % Wt | | |
| C | 84.68 | 84.67 |
| H | 10.63 | 6.10 |
| N | 0.39 | 1.32 |
| S | 3.45 | 5.19 |
| O | 0.76 | 2.66 |

Visbreaking with coal, followed by deasphalting gives 81% and 89% demetallation of nickel and vanadium from the Joliet vacuum residue.

If I were building a plant today to process a Boscan or Joliet resid, I would add about 20 wt % coal to the feed to the unit. I would operate the visbreaker at a temperature of about 850° F., and LHSV of 10 v/v per hour with a pressure 500 psig.

I would use as an antisolvent light naphtha, and operate at a solvent/feed ratio of 0.2 and a temperature of 500° F.

I would steam strip the recovered solids, to lower the volatile hydrocarbon content to 10%.

The stripped solids would be separated in a flotation unit to recover 40% as organic solids, and 60% as an inorganic sediment.

The inorganic sediment would be burned in a fluid bed combustion chamber operated at 1800° F. I would add $Na_2CO_3$ to the combustor to promote subsequent metals recovery.

What is claimed is:

1. A process for heavy hydrocarbon oil demetallation and metals recovery which comprises:

(a) heating an admixture of 70 to 95 wt % heavy hydrocarbon oil containing at least one metal selected from the group consisting of vanadium and nickel and 5 to 30 wt % particulate coal under visbreaking conditions to produce a visbroken liquid with a reduced metals content containing solids; and (b) recovering from the visbroken liquid an oil fraction with reduced metal content and a solids fraction containing at least about 30% of the metal in said heavy hydrocarbon oil.

2. The process of claim 1 wherein said admixture contains 75 to 85 wt % heavy hydrocarbon oil and 15 to 25 wt % coal.

3. The process of claim 1 wherein said visbroken liquid is separated into an oil fraction and a solids fraction by charging the visbroken liquid containing solids to a hot settler maintained at about 30° to 300° C. for a time sufficient to allow a majority of the particulate matter in said stream to settle.

4. The process of claim 1 wherein said solids fraction is oxidized with an oxygen containing gas to form a metal rich synthetic ore.

5. The process of claim 1 wherein said solids fraction is contacted with steam to remove steam strippable oil components from said solid fraction.

6. The process of claim 1 wherein said solids fraction is contacted with a solvent to remove solvent strippable oil components therefrom.

7. The process of claim 1 wherein said solids fraction is subjected to flotation separation to provide an organic solids float phase and an inorganic sink phase, and said sink phase is burned to form a metal rich synthetic ore containing a majority of the metals removed from the oil and substantially free from organic matter.

8. The process of claim 1 wherein the heavy hydrocarbon oil feedstock is a distillation residuum of crude oil.

9. The process of claim 1 wherein the particulate coal is finely divided bituminous coal.

10. The process of claim 1 wherein said admixture contains about 80 wt % heavy hydrocarbon oil and about 20 wt % coal.

11. The process of claim 1 in which said solid fraction is burned at a temperature below the fusion point of said coal.

12. The process of claim 1 wherein said solids fraction is burned in a fluidized bed.

13. The process of claim 11 wherein $Na_2CO_3$ is added to said combustion zone.

14. A process for demetallation of heavy hydrocarbon oil containing at least 50 ppm of metals selected from the group comprising vanadium and nickel, which process comprises (a) heating an admixture of 75 to 85 wt % of said oil and 15 to 25 wt % particulate coal in a visbreaking reactor under visbreaking conditions which include a temperature of 800° to 950° F. and a weight hourly space velocity of about 1 to 100, and wherein said temperature and space velocity are sufficient to substantially reduce the viscosity of said oil while preventing coking of said feed to produce a visbroken liquid with a reduced viscosity and a reduced metals content but containing coal solids;

(b) recovering from said visbroken liquid an oil fraction with a reduced metals content and a solids fraction containing at least about 30 percent of the metal in said oil feed, and wherein at least a majority of the metals removed from said oil are recovered on said solids;

(c) oxidizing said solids fraction to form a metal rich synthetic ore.

15. The process of claim 14 wherein said visbroken liquid is separated into an oil fraction and a solids fraction by charging the visbroken liquid containing solids to a hot settler maintained at about 30° to 300° C. for a time sufficient to allow a majority of the particulate matter in said stream to settle.

16. The process of claim 14 wherein said solids fraction is oxidized in a fluidized bed, at a temperature below the fusion point of said solids, with an oxygen containing gas to form a metal rich synthetic ore.

17. The process of claim 14 wherein said solids fraction is contacted with steam or a solvent to remove strippable oil components therefrom.

18. The process of claim 14 wherein said admixture contains about 80 wt % heavy hydrocarbon oil which is a distillation residuum of crude oil, and about 20 wt % finely divided bituminous coal.

* * * * *